US005193626A

United States Patent [19]

Jacob

[11] Patent Number: 5,193,626

[45] Date of Patent: Mar. 16, 1993

[54] DRILLING DEVICE

[75] Inventor: Wilhelm Jacob, Velbert, Fed. Rep. of Germany

[73] Assignee: Rudolf Hausherr & Sohne GmbH & Co. KG, Sprockhovel, Fed. Rep. of Germany

[21] Appl. No.: 681,497

[22] PCT Filed: Aug. 17, 1990

[86] PCT No.: PCT/EP90/01353

§ 371 Date: Apr. 23, 1991

§ 102(e) Date: Apr. 23, 1991

[87] PCT Pub. No.: WO91/02880

PCT Pub. Date: Mar. 7, 1991

[30] Foreign Application Priority Data

Aug. 24, 1989 [DE] Fed. Rep. of Germany ..... 3927952

[51] Int. Cl.[5] ..... E21C 1/06; E21B 17/18

[52] U.S. Cl. ..... 173/197; 175/320

[58] Field of Search ..... 173/197, 199, 77, 135, 173/138; 175/21, 320

[56] References Cited

U.S. PATENT DOCUMENTS

| | | | |
|---|---|---|---|
| 2,215,928 | 9/1940 | Hornbrook | 173/197 |
| 2,716,393 | 8/1955 | Fischer | 173/206 |
| 3,007,534 | 11/1961 | Salnikov et al. | 175/320 |
| 3,151,687 | 10/1964 | Sato et al. | 175/320 |
| 3,766,991 | 10/1973 | Brown | 173/197 |
| 3,800,887 | 4/1974 | West | 173/197 |
| 4,020,909 | 5/1977 | Airaudo | 173/197 |
| 4,702,328 | 10/1987 | McSweeney . | |
| 4,834,594 | 5/1989 | Morgan . | |

FOREIGN PATENT DOCUMENTS

| | | |
|---|---|---|
| 8908769 | 9/1989 | Fed. Rep. of Germany . |
| 2469551 | 5/1981 | France . |

*Primary Examiner*—Frank T. Yost
*Assistant Examiner*—Scott A. Smith
*Attorney, Agent, or Firm*—Herbert Dubno; Yuri Kateshou

[57] ABSTRACT

A drilling device including a hydraulically actuated drive for exerting an oscillatory action on the drive including the drive element, inserting device for hoses conducting a working medium to a pressure-actuated hammer mounted on a front end of the rod and the flushing head at an oscillation angle ranging between 180°-360°. The flushing head is fixed oscilatorily with the drive member and both are swingable about a swivelling axis out of an alignment with the slide and the drive member is formed with a recess for selectively attaching a respective plug-in rod end of the drill rod, so that a torque produced by the drive is transmitted to the drill rod by the drive unit upon interlocking of the flushing head and rod.

6 Claims, 2 Drawing Sheets

DRILLING DEVICE

CROSS REFERENCE TO RELATED APPLICATIONS

The present application is a National Phase application corresponding to PCT/EP90/01353 filed Aug. 17, 1990 and based, in turn, upon an application P 39 27 952.9 filed in Germany under the International Convention.

The present invention relates to a drilling device, particularly for the drilling of shot holes, with a carriage slide for the advance and retraction of the drill rod assembly formed of individual drill rods, and including a feeding system and a pressure-medium actuated drive for the drill rod assembly. More particularly the invention relates to a system of this type located on a slide movably mounted on the carriage, as well as with a hydraulically actuated intra-hole hammer, whereby the drive for the drill rod assembly transmits to the latter a to-and-fro oscillatory motion , preferably with an oscillation angle of 180–360 degrees, and the drill rods are provided with two outwardly opening longitudinal channels for the accommodation of hydraulic hoses for the supply and return flow of the pressure oil for the intra-hole hammer and a compressed air line, and a hose insertion and retraction mechanism is mounted on the slide of the drive for the drill rod assembly and is directly or indirectly linked to the drive member.

BACKGROUND OF THE INVENTION

In the known drilling device over which the present invention is an improvement, in order to transmit the torque from the oscillating drive to the drill rod assembly, the drill rods are provided with a contour so that an interlocking results (see German Patent Document 38 42 081 and U.S. Pat. No. 5,092,411). The same result may be realized by means of a clamping device. The advance as well as the extraction are performed via the chain drive of the flushing head. As soon as the slide reaches its lower position and the flushing head has been retracted into its upper starting position, a new drill rod from a drill rod magazine can be inserted. The spent drill rod assembly in the bore hole is kept in place in the usual manner by a mounting head. At this point, the slide is brought back to its upper position via a special drive.

While the slide is being brought back to this position, the hydraulic hoses are pressed into the longitudinal channels of the newly inserted drill rod by the hose insertion and retraction mechanism, whereafter the boring operation of the newly inserted drill rod can start. When the rod system is pulled out, the process takes place in reverse order, whereby from each of the removed drill rods the hydraulic hoses are pushed out by the retraction elements during the travel of the slide. When the drill rods are designed as hollow rods, the flushing air is supplied through them. However, if they are made of a solid material, the flushing air for the intra-hole hammer cannot be blown through the interiors of the drill rods, so that they must be equipped with ducts for the blast air.

OBJECT OF THE INVENTION

It is the object of the invention to improve the drilling device of the aforedescribed type so that the torque transmission of the oscillating drive to the drill rod assembly can take place without providing any special contour of the drill rods constituting the drill rod assembly and/or without additional clamping devices.

SUMMARY OF THE INVENTION

According to the invention, this object is achieved by having the flushing head, the hose insertion and removal mechanism, as well as the actuation element of the oscillating drive form a drive unit, which is swingably mounted on the slide of the carriage. The flushing head in the drive unit is swingable about an axis running transversely with respect to the longitudinal axis of the drill rods. The flushing head has a recess in its connection area with the drill rod ends. The recess is shaped to fit one of the drill rod ends, so that the torque transmission for the drill rods takes place through interlocking. Because of this construction, the flushing head does not perform only the customary advance movement and the extraction of the drill rods system, but also transmits the oscillatory movement of the oscillating drive to the drill rod assembly due to interlocking. The torque transmission takes place through the normally used plug-in ends of the drill rods, which are, for instance, square or hexagonal, in cooperation with a correspondingly shaped recess in the lower area of the flushing head. In the uppermost position of the drive unit, the flushing head is swung into its working position for the connection with the upper ends of the drill rods to be mounted. After the drill rods have finished storing, the flushing head is swivelled laterally outside the axis of the drill rod assembly, so that the drive unit can travel back and, at the same time, the insertion of the hydraulic hoses in the drill rod next in line for mounting is effected.

In the recess of the flushing head a bore running transversely thereto for receiving the holding pin at the plug-in ends of the drill rods is provided, these pins lodging under spring action in the drill rods. In order to facilitate the release of these holding pins, the bore extends outwardly in order to receive the holding pins, so that the holding pins can be pressed from the outside against the action of the springs and the flushing head can be released. In order to simplify this operation as much as possible, the outwardly extending bore can continue with a segment having an enlarged diameter.

The swinging of the flushing head is advantageously performed by means of a pressure-medium actuatable cylinder and piston unit, which from the control point of view is integrated in the general operating cycle of the drilling device.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
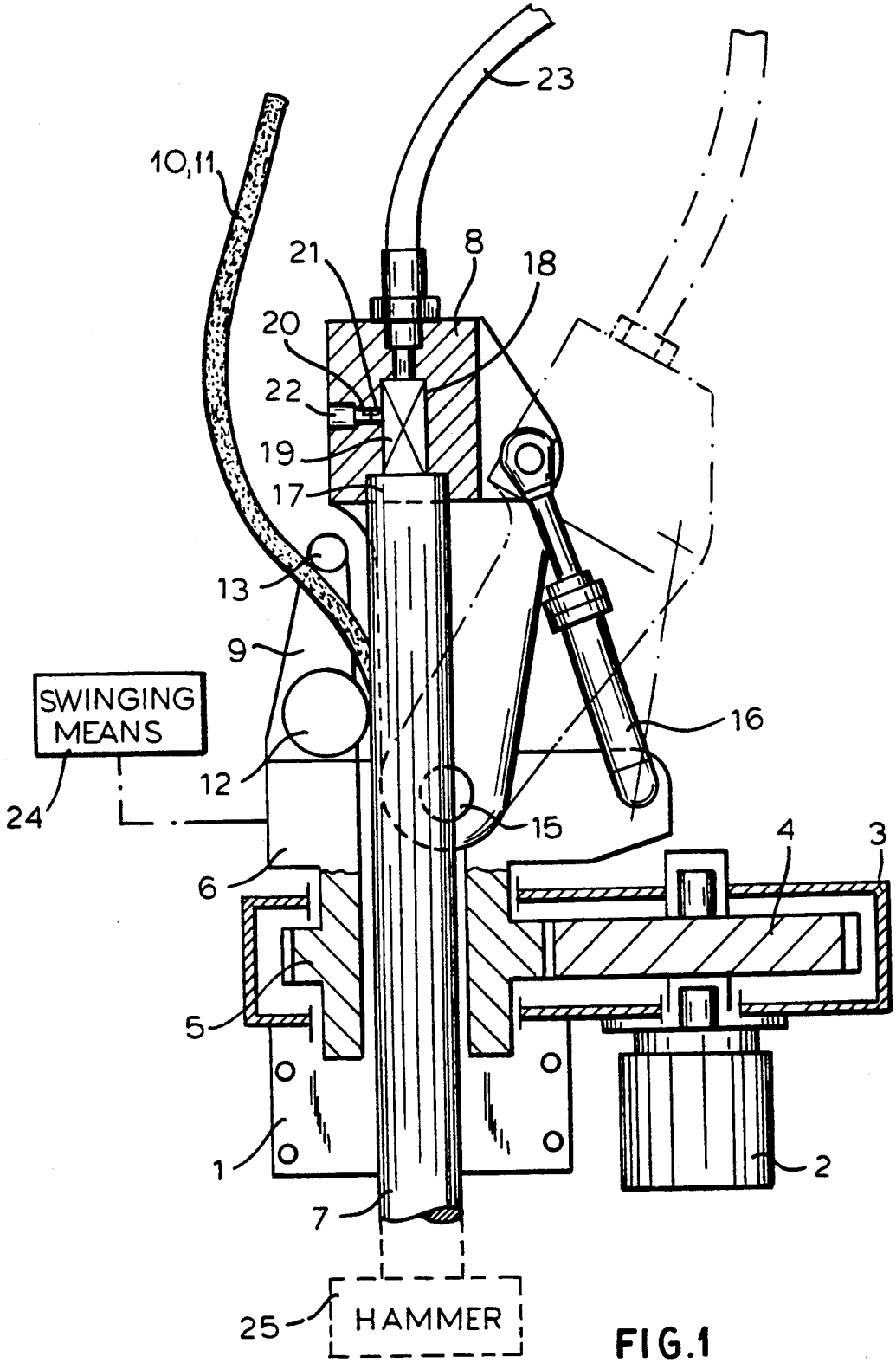
FIG. 1 is a longitudinal sectional view of a carriage of the drill.
Figure 2:
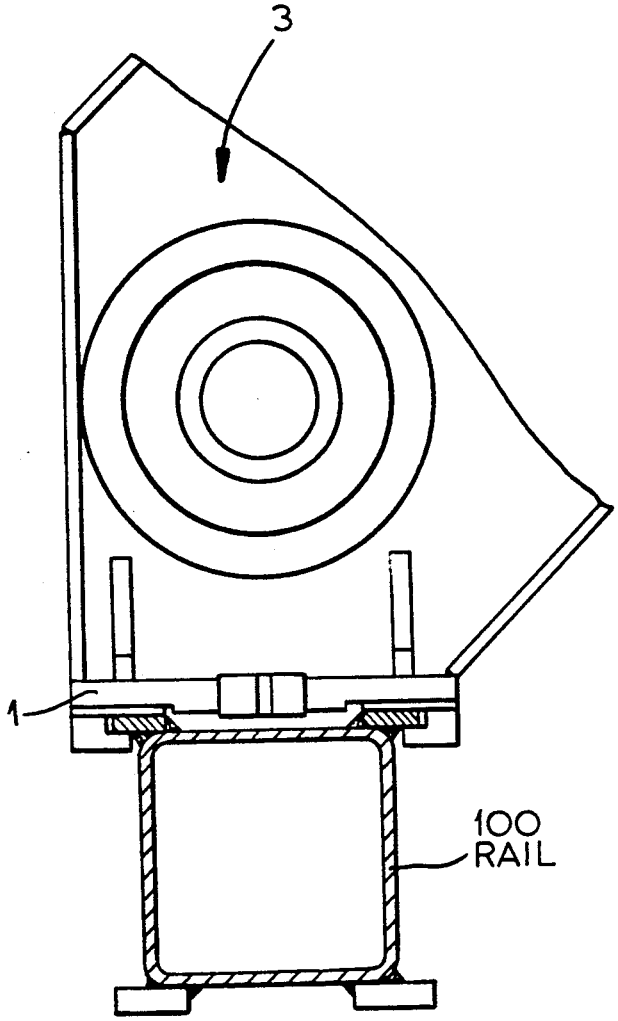
FIG. 2 is a partial sectional vertical view of the gearing mechanism mounted on a slide.

The slide 1 is slidably mounted on a carriage not not shown separately in the drawing—of the drilling device. On the slide 1, the pressure-medium-actuated drive 2 is fastened, this drive being an oscillating motor with gearing 3. The pinion 4 of gearing 3 meshes with the toothed crown gear 5, which is located on the drive element 6 for the drill rod system consisting of individual drill rods 7. The drive element 6 forms together with the flushing head 8 and the hose insertion and removal mechanism 9 a drive unit which is swingably mounted on the slide 1 of the carriage of the drill, about the longitudinal axis of the drill rods 7, by means 24 and represent the oscillation axis. The hose insertion and removal mechanism 9 is provided with one insertion element 12 and one retraction element 13 for each hydraulic hose 10, 11.

The flushing head 8 is swingable in the drive unit about an axis 15 running transversely to the longitudinal axis of the drill rods 7, by means of a pressure-medium-actuated cylinder and piston unit 16.

The flushing head 8 has a recess 18 in its connection area for the drill rod ends 17, the shape of this recess corresponding to the configuration of the plug-in ends 19 of the drill rods 7 and being adjusted thereto so that torque transmission to the drill rods 7 takes place through interlocking. The plug-in ends can, for instance, be square or hexagonal and the recess 18 of the flushing head 8 can be correspondingly shaped. It is also possible that the drill rods be provided at their ends with mutually adjusted shaped parts for the corotational connection of the drill rods as well as for the connection and alignment of their longitudinal channels.

In the recess 18 of the flushing head 8 a bore 20 running transversely thereto is provided for receiving the holding pin 21 on the plug-in ends 19. The holding pins 21 are subjected to the action of a spring and therefore come to lodge automatically in the bore 20. The bore 20 extends outwardly, preferably over a segment 22 with enlarged diameter, so that it is possible to push back the holding pins 21 of the plug-in ends 19 of the drill rods 7 in order to release the flushing head 8.

The drive 2 for the drill rod assembly transmits to the intra-hole hammer, as described in the aforementioned German Patent document, a to-and-fro oscillatory motion, with an oscillation angle of 180—360 degrees, and the drill rods are provided with two outwardly opening longitudinal channels for the accommodation of the hydraulic hoses 10, 11 for the supply and return flow of pressure oil for the intra-hole hammer 25 and with a blast-air line.

The device according to the invention operates as follows:

In the position shown in the drawing the flushing head 8 with its recess 18 is fitted onto the plug-in end 19 of a drill rod 7 brought forward from a magazine not shown in the drawing, whereby the holding pin 21 of the plug-in end 19 lodges in the bore 20 of the flushing head 8. The delivery of the flushing air to flushing head 8 takes place through the flushing-medium hose 23. Now the drilling operation can be performed by the drill rod assembly, whereby the advance of the slide 1 is effectuated over the usual chain drive . After the drilling has been completed by the present drill rod 7, the drill rod assembly is held in a known manner by a mounting head. Now, the holding pin 21 is released, the slide is moved upwards and after release of the plug-in end 19 it is swung outwardly in the position shown in broken lines in the drawing by actuating the cylinder and piston unit 16.

By bringing in a new drill rod from a magazine not shown in the drawing, the next drill rod 7 is set and the drill rod end 17 of the drill rod assembly is introduced in the drill rod end wit recess of the next available drill rod, whereby the holding pin 21 lodges in a corresponding bore in the recess of the drill rod end, in the same way as in the bores 20 of the flushing head 8. The drill rod 7 which is now connected with the drill rod assembly is held by an arresting lever of the drill rod magazine, so that the drill rod magazine can be swung out and retracted to its initial position whereby the hydraulic hoses 10, 11 are "threaded in" by the insertion and removal mechanism 9. In the uppermost position of the drive unit, the flushing head 8 is swung back into its working position shown in the drawing and connected with the drill rod end 19, so that the next available drill rod 7 can perform the drilling operation in the same way.

The extraction of the drill rod assembly takes place in the reverse order, whereby then each time from the drill rod 7 to be extracted the hydraulic hoses 10, 11 are pushed out by the removal elements 13.

I claim:

1. A drilling device for drilling shot holes, comprising:

a slide carriage slidable along a longitudinal axis;

a oscillation pressure-medium-actuated drive mounted on said slide; and a drill-rod assembly mounted on said slide, said assembly comprising:

at least one drilling rod having front and plug-in ends and being provided with two outwardly opening longitudinal channels, a hydraulically actuated in-hole hammer mounted on said front end of said drilling rod, a pressure-operated drive system swingable about said longitudinal axis for transmitting a torque produced by said drive to said hammer, said drive system oscillating at an angle ranging between 180° to 360° and including:

a drive member operatively connected and driven by said oscillation drive, retracting means operatively connecting with said drive member for inserting a pair of hoses into and out of said channels of the respective rod, said hoses conducting pressure oil to and from said in-hole hammer, a flushing head oscillatory fixed with said drive member and retracting means, said head receiving a blast-air line and being provided with a recess receiving said plug-in end of the respective drilling rod, so that said flushing head is detachably connected with said rod, and swivelling means for swiveling said flushing head about a swivel axis skewing said longitudinal axis out of an alignment with said slide for receiving the respective rod, said drive system transmitting said torque to said rod upon interlocking said head with said plug-in end of the rod.

2. The drilling device defined in claim 1 wherein said plug-in end of said flushing head is provided with a bore running transversely into said recess, said bore receiving a holding pin.

3. The drilling device defined in claim 2 wherein said bore extends outwardly.

4. The drilling device defined in claim 3 wherein said bore is formed a segment having an enlarged diameter.

5. The drilling device defined in claim 2 wherein said swivelling means includes a pressure-medium-actuated cylinder and piston unit.

6. The drilling device defined in claim 2, further comprising means swinging said drive unit on said slide and means for controllably actuating said drive system and said swivelling means.

* * * * *